US007963892B2

(12) United States Patent
Poblete Castro et al.

(10) Patent No.: US 7,963,892 B2
(45) Date of Patent: Jun. 21, 2011

(54) DUMBBELL SYSTEM FOR MUSCLES WORK

(75) Inventors: Jose Luis Poblete Castro, Santiago (CL); Antonella Stefania Dinali Alvarado, Santiago (CL)

(73) Assignee: Universidad Technologica Metropolitana, Santiago (CL)

( * ) Notice: Subject to any disclaimer, the term of this patent is extended or adjusted under 35 U.S.C. 154(b) by 0 days.

(21) Appl. No.: 12/428,904

(22) Filed: Apr. 23, 2009

(65) Prior Publication Data

US 2010/0273613 A1 Oct. 28, 2010

(51) Int. Cl.
*A63B 21/072* (2006.01)
*A63B 23/16* (2006.01)

(52) U.S. Cl. ..... 482/108; 482/44

(58) Field of Classification Search ..... 482/106–109, 482/44–49; D21/680–684
See application file for complete search history.

(56) References Cited

U.S. PATENT DOCUMENTS

| | | | | |
|---|---|---|---|---|
| 5,090,693 | A * | 2/1992 | Liang | 482/108 |
| 5,379,909 | A * | 1/1995 | Roark | 215/329 |
| 5,496,244 | A * | 3/1996 | Caruthers | 482/108 |
| 6,709,371 | B2 * | 3/2004 | Wu | 482/108 |
| 6,939,276 | B2 * | 9/2005 | Gates | 482/111 |
| 7,097,601 | B1 * | 8/2006 | Ronnow | 482/106 |
| 7,175,572 | B2 * | 2/2007 | Stonecipher | 482/106 |
| 7,326,122 | B2 * | 2/2008 | Park | 473/256 |
| 2003/0060346 | A1 * | 3/2003 | Wu | 482/108 |
| 2004/0198568 | A1 * | 10/2004 | Stonecipher | 482/106 |
| 2005/0079961 | A1 * | 4/2005 | Dalebout et al. | 482/106 |
| 2007/0049473 | A1 * | 3/2007 | Chapman et al. | 482/121 |

* cited by examiner

*Primary Examiner* — Fenn C Mathew
(74) *Attorney, Agent, or Firm* — Hasse & Nesbitt LLC; Daniel F Nesbitt

(57) ABSTRACT

A dumbbell system that allows a single arm working and alternatively a simultaneous and symmetrical working of both arms to fortify specific muscles, including biceps, triceps and back muscles. The dumbbell system includes a dumbbell unit and either a single weight plate attachment means, or a double weight plate attachment means to connecting two dumbbell units to each other.

13 Claims, 6 Drawing Sheets

DUMBBELL SYSTEM FOR MUSCLES WORK

BACKGROUND OF THE INVENTION

The present invention relates to a dumbbell for weight lifting work and particularly to a dumbbell system with improved features that allows working and fortifying some specific muscles, including biceps, triceps and back muscles through a simultaneous and symmetrical work of both arms and alternatively one arm at a time.

Some of the existing muscle-working apparatii consist of complex and big exercise machines, and other kinds, like manual, small devices that are simply to use, like dumbbells.

Some of the existing manual dumbbells aim to work the chest and arms muscles are described in U.S. Pat. Nos. 4,813,669 and D242,865, incorporated herein by reference. Both patents show small dumbbells that are easy to manipulate, but that have a single weight amount, such that the user is prevented from changing or increasing the desirable weight.

This disadvantage is solved by U.S. Pat. Nos. 4,109,908 and 5,971,339, incorporated herein by reference, that allows changing the weight amount through small weight plates.

As seen in the U.S. Pat. No. 4,109,908, the device allows changing the weight, but the shape and functionality are complex because the device has to be supported over the forearm and the weight device rests over the forearm, causing a restricted working position. U.S. Pat. No. 5,971,339 shows a simpler shape, but prevents a symmetrical muscle workout or exercise since the device is not able to be lifted with both arms at a time.

The present invention allows changing the weight requested, allows working specific muscles work and a symmetrical workout with a dumbbell system comprising some suitable elements that can be combined to each other that improves the safety and provides a comfortable gripping feature.

SUMMARY OF THE INVENTION

The present invention relates to dumbbells for weight lifting and particularly to a dumbbell system with improved features that allow working and fortifying some specific muscles, including biceps, triceps and back muscles, through a simultaneous and symmetrical working of both arms and alternatively one arm at a time. This kind of body work equipment is aimed to professional volleyball players or similar sports.

Professional volleyball players need to increase musculature in the arms, back and shoulders, because their usual movements are concentrated in launching or striking the ball with one or both arms.

The technical problem relates to a specific, both-arms symmetrical muscular working and optionally a single-arm muscular working, to getting a suitable body position to work, to allowing an easy changing of the weight plates, and to improving the safety and comfort of the muscle working conditions.

The dumbbell system comprises two dumbbell units, one identical to the other, and two different attaching means, one of the attaching means for attaching a load or weight disc to the individual dumbbell unit, and the other attaching means for attaching two dumbbell units to each other and keeping the load discs between them.

Each dumbbell unit consists of a disc-shaped body including a weight plate locking means on a first body face, and a hand retainer and a hand adapting means on a second body face.

The hand retainer means consists of an arc-shaped piece or loop projected from and attached at two diametric points of the second body face, under which the user's hand is inserted and retained.

The arc-shaped piece or loop has a regular or constant cross-sectional thickness, but its cross-sectional width dimension increases in the top side of the arc and next to the bottom of it. Only one of the sides of the arc-shaped piece has a concave notch that is coated with the foamed material, so the cross section width is completed by said foamed material.

The concave notch covered by the foam material can receive the thumb finger concavity of the hand, so the user's gripping action is improved in comfort and safety.

As previously disclosed, the disc-shaped body comprises a hand adapting means, designed specifically to receive the hand palm, and can consist of a semispherical-shaped pad or pillow, upon where the cavity of the palm of the hand rests.

The pillow is typically constructed of a cushioning material with soft features, like polyurethane foam.

The disc-shaped body presents, on the second body face opposite the body side with the arc element, a locking mechanism consisting of a threaded stem, made of a metal such as steel, to fix or secure one or more weight plates to the dumbbell unit.

The weight plates used with the device and method of this invention, are typically traditional disc weights, including plates with a circular shape having a circular perforation or aperture through the center.

The attaching means comprises two different types. One attaching means is a single attachment means, for attaching one or more weight plates to a dumbbell unit. The other attaching means consists of a double attachment means, for attaching two dumbbell units together with the double attachment means between.

The single attachment means includes a solid disc piece having two opposite faces and a contouring wall, constructed of a polymeric material, preferably ABS, which contouring wall presents a plurality of elliptical depressions, which acts as a non-skid or gripping surface, thereby improving the user's gripping and twisting action of the solid disc piece.

One of the two opposite faces of the single attachment means has a smooth surface, while the opposite face includes a central annular projection with a threaded interior surface to fit or mate with the threaded stem of the disc-shaped body and retains the weight plate to the dumbbell unit.

The double attachment means includes a solid, disc-shaped piece, having two opposite faces and a vertical contouring wall, constructed of a polymeric material, preferably ABS. The vertical contouring wall has a plurality of elliptical depressions, which act as a non-skid or gripping surface to improve the user's gripping and twisting action of the disc-shaped piece.

Both opposite faces of the double attachment means include a central annular projection with a threaded interior surface to fit or mate with the threaded stem of two disc-shaped body units, and retain weight plates between the two disc-shaped body units. So, this double attachment means allows fixing two dumbbell units by their second body faces.

Further features, aspects and advantages of the present invention will become more apparent from the following description of the preferred embodiment and accompanying drawings, in which:

BRIEF DESCRIPTION OF THE DRAWINGS

FIG. 2 is an exploded perspective view of the invention, showing two dumbbell units with the double attachment means in between.

DETAILED DESCRIPTION OF THE INVENTION

Figure 1:
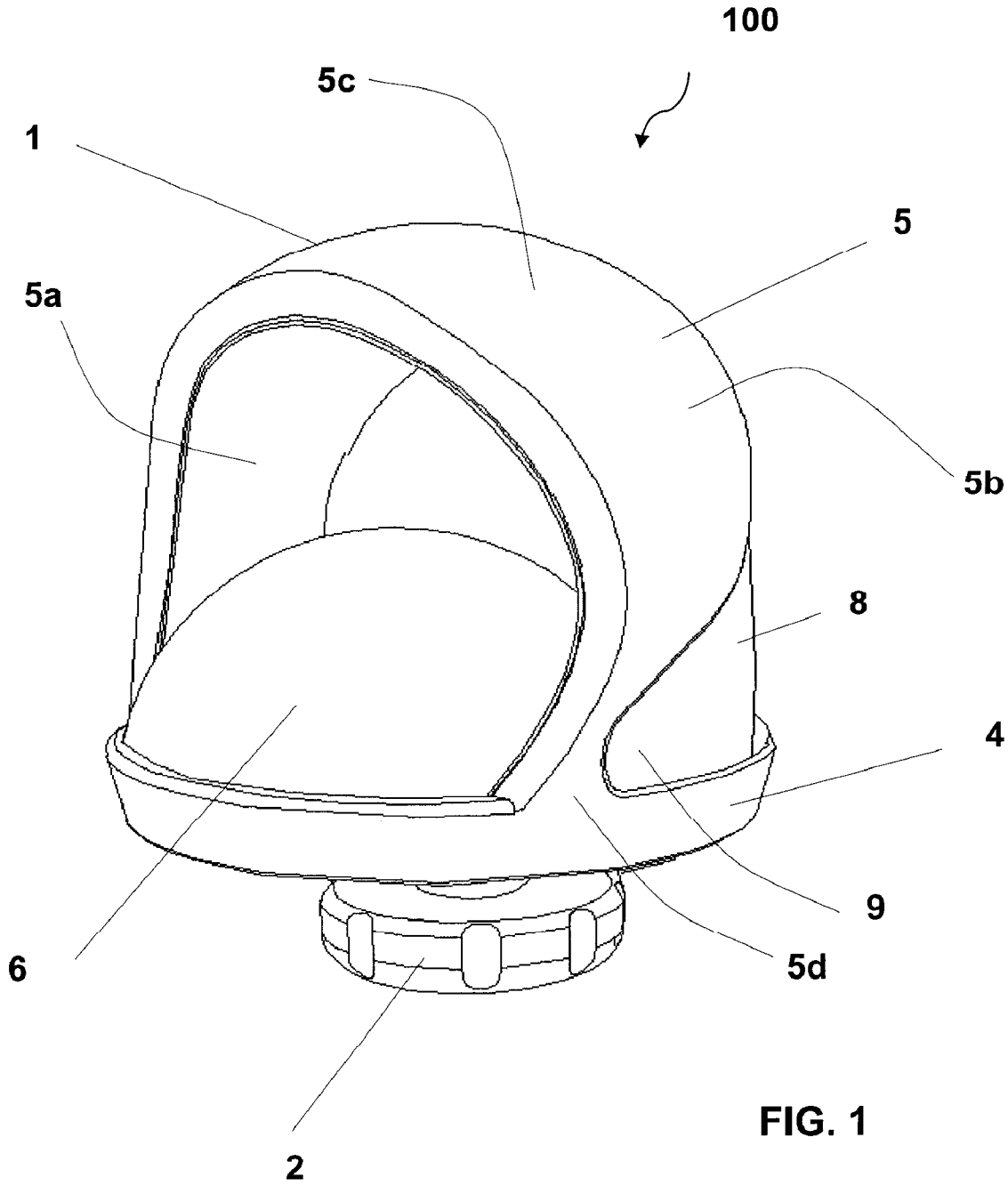
FIG. 1 is a perspective view of the invention, showing a dumbbell unit with the single attachment means.
Figure 2:
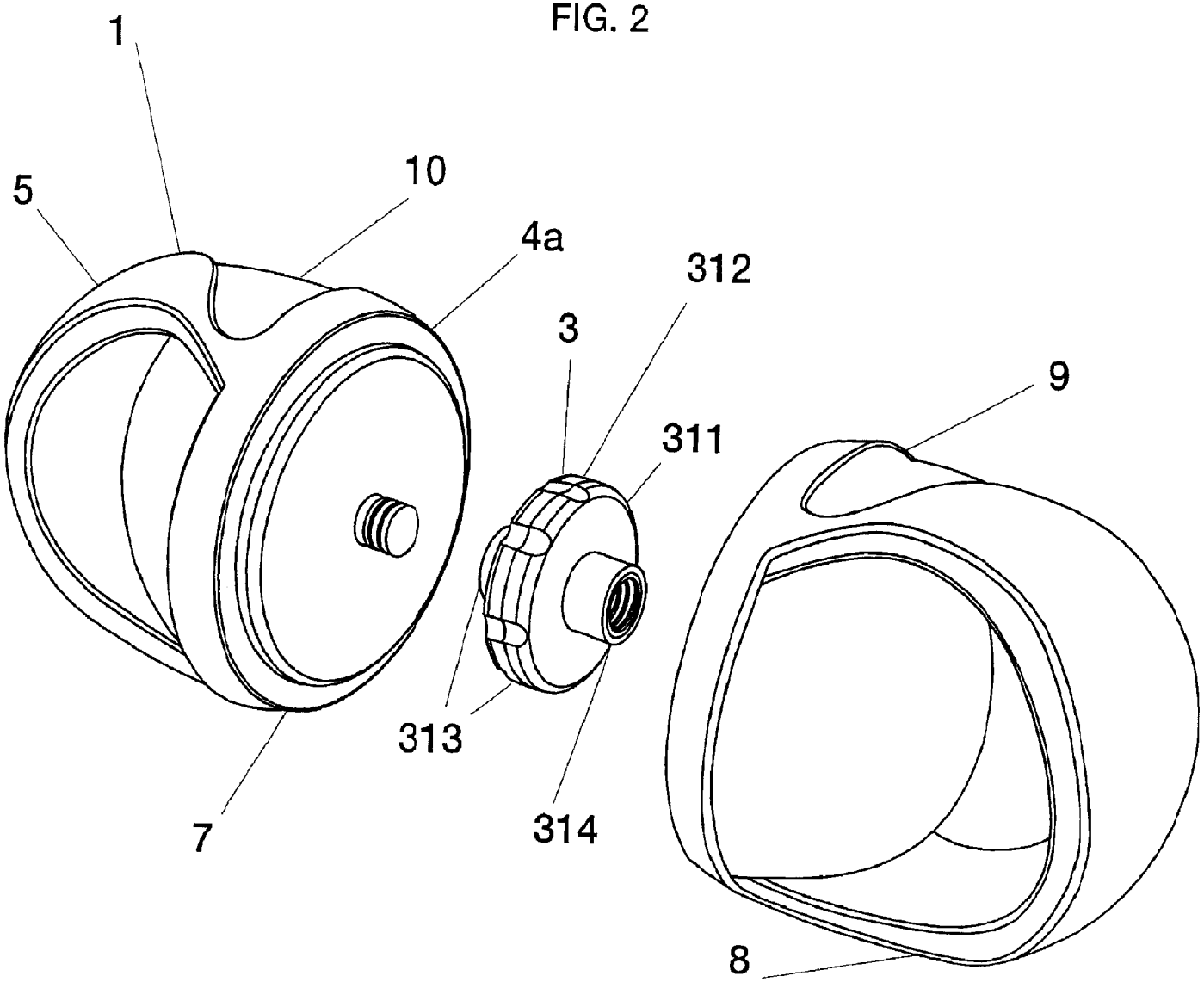
Figure 3:
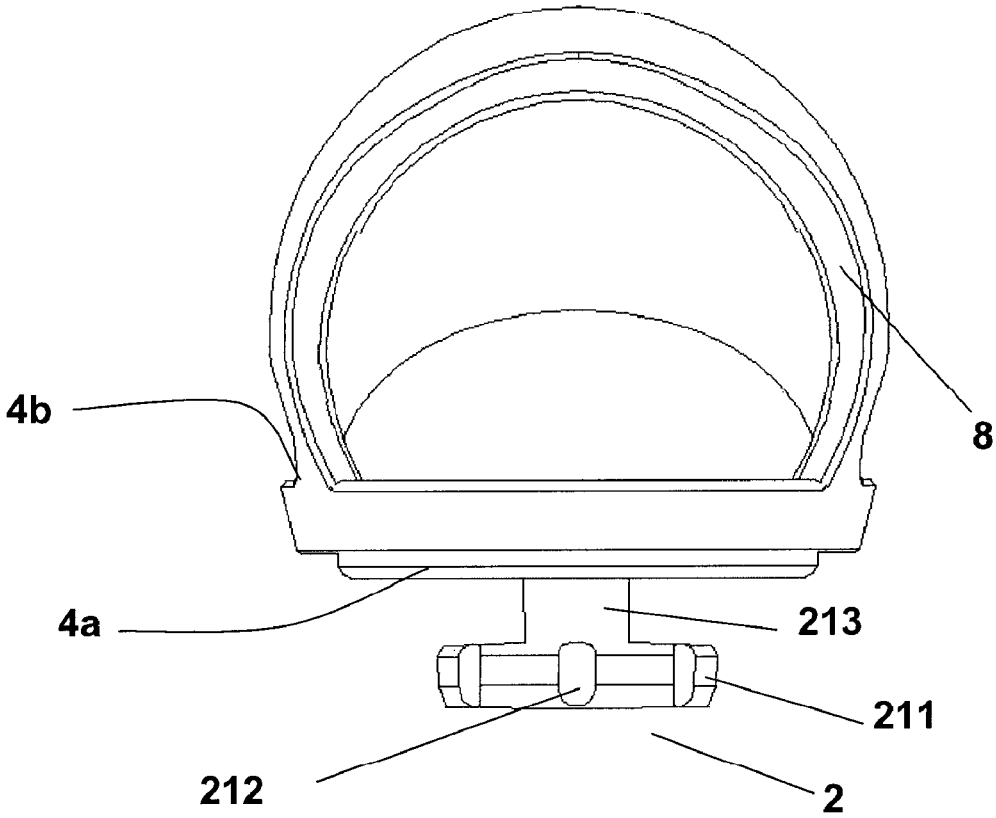
FIG. 3 is a front view of the invention, showing a dumbbell unit attached to the single attachment means.
Figure 4:
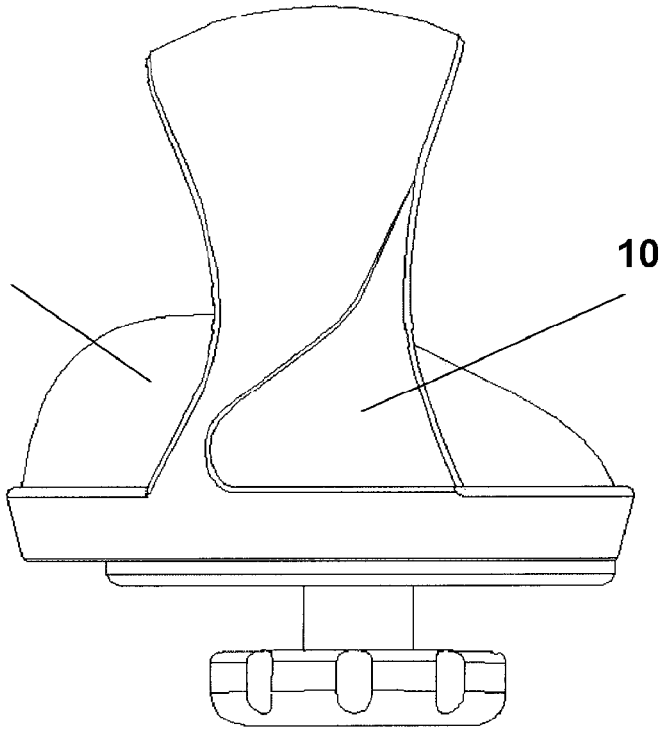
FIG. 4 is a left side view of the invention, showing a dumbbell unit attached to the single attachment means.
Figure 5:
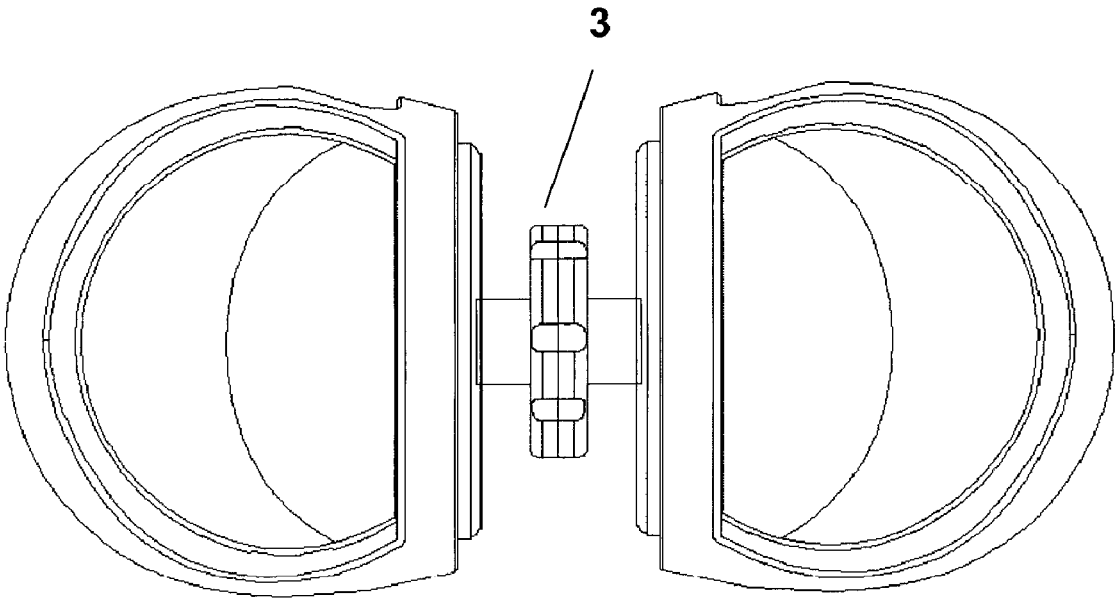
FIG. 5 is a front view of the invention, showing two dumbbell units attached to the double attachment means.
Figure 6:
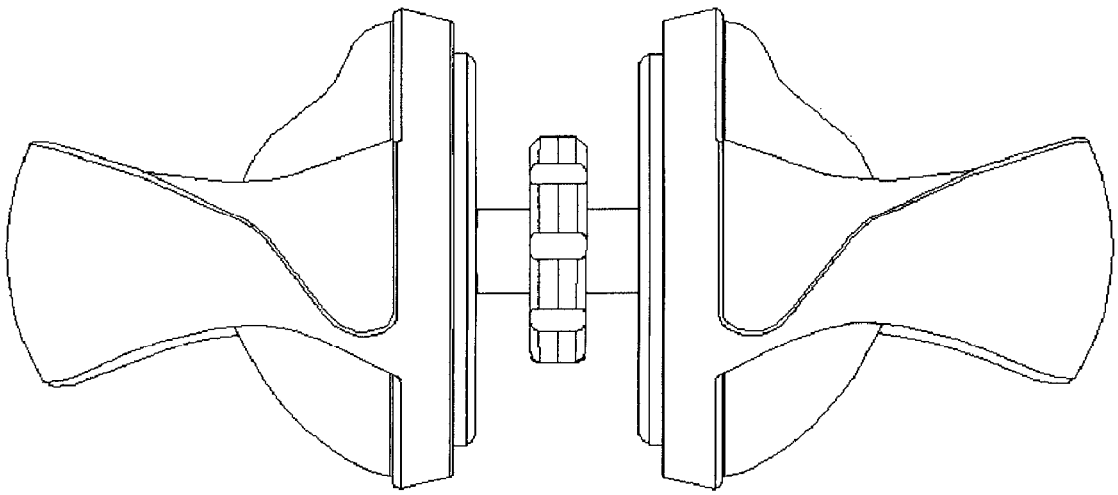
FIG. 6 is a top view of the invention shown in FIG. 5, showing two dumbbell units attached to the double attachment means.
Figure 7:
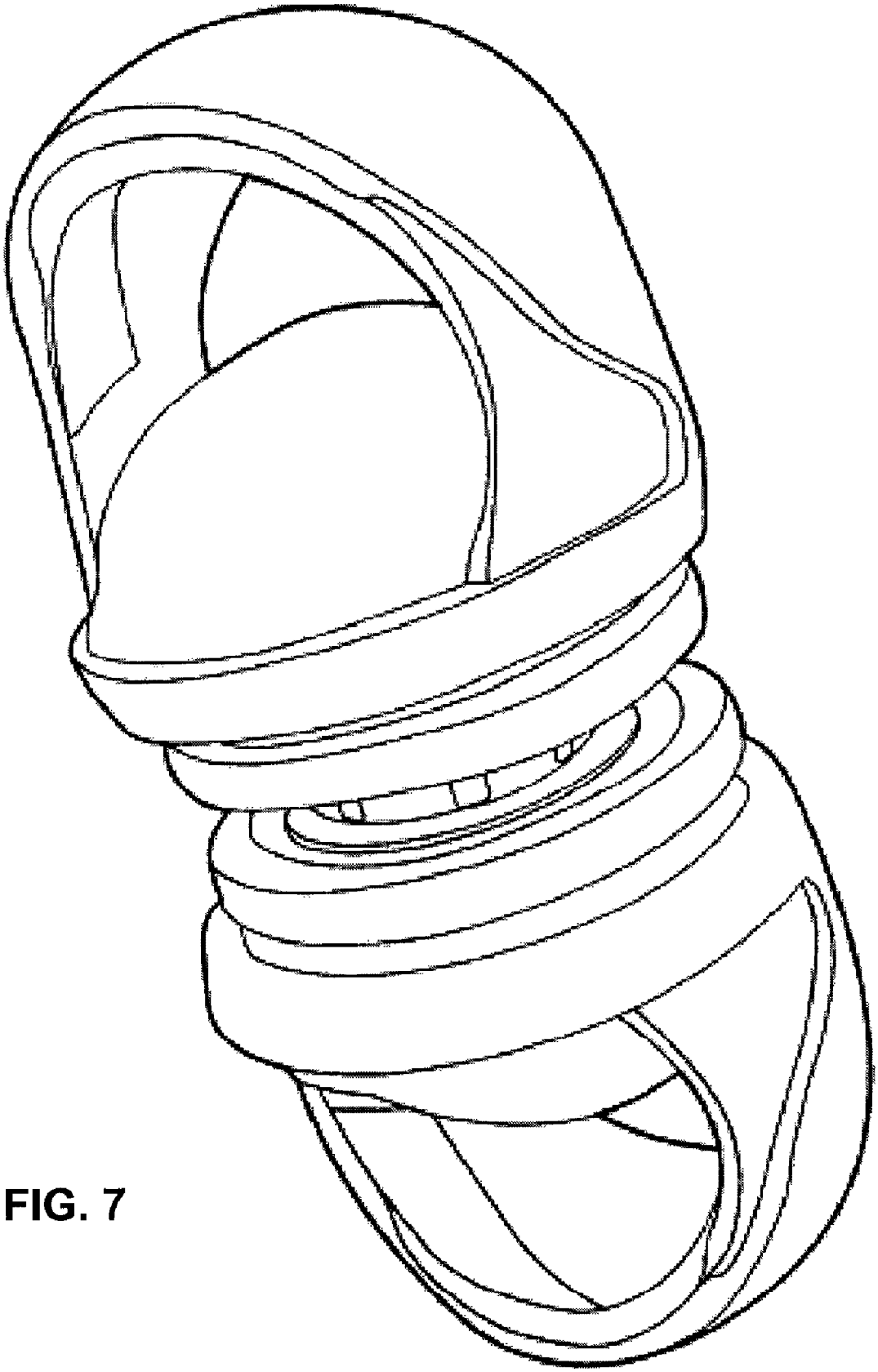
FIG. 7 is a perspective view of dumbbell system shown in FIG. 2, with the two dumbbell units attached to the double attachment means.
Figure 8:
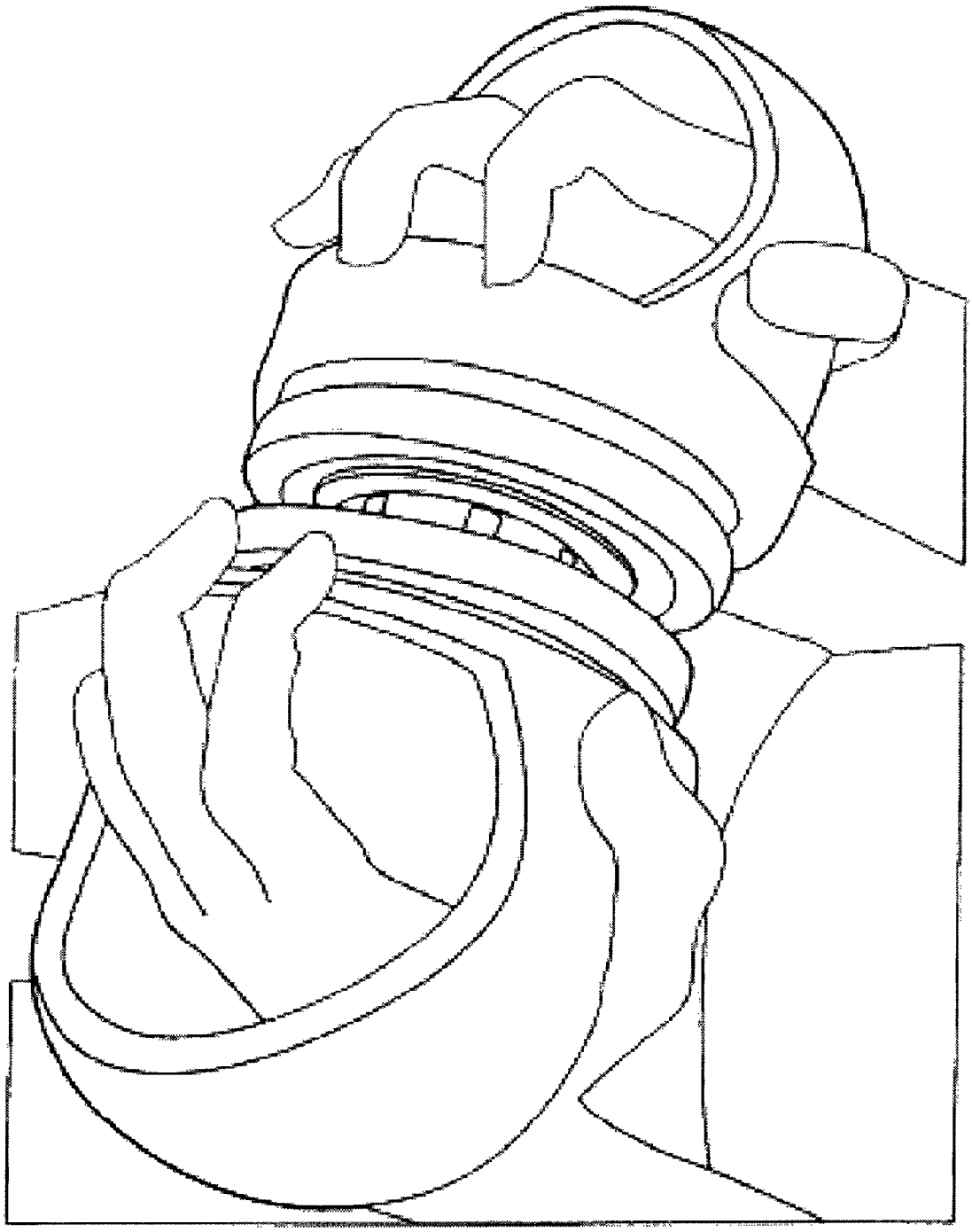
FIG. 8 shows the dumbbell system of FIG. 7 in use.

The dumbbell system 100 shown in FIGS. 1-4 comprises two individual dumbbell units 1, one identical to the other, and with two different types of an attachment means. A first single attachment means 2 attaches a weight plate to the dumbbell unit 1. The second double attachment means 3 attaches two dumbbell units 1 together to keep weight plates there between. The attachments means 2 and 3 are not the weights used for exercising, but they hold separate weights as shown in FIGS. 3 and 5.

Each dumbbell unit 1 includes in a thick disc-shaped body 4 with a weight plate single attachment means 2 or a double attachment means 3 attached to a first body face 4*a*, and a hand retainer means 5 and hand adapting means 6 attached to the second opposed face 4*b*.

The hand retainer means includes an arc-shaped piece or loop 5, disposed above or over the second face of the disc-shaped body 4, which presents an exterior and an interior surface. The arc shape of the hand retainer means forms and provides a passing through space where the user's hand is inserted and retained. The arc-shaped piece 5 is configured and formed as a unitary part with the body 4, and its interior surface is coated with a foam material 8.

The hand retainer means, shown as the arc-shaped piece 5, has a regular or constant cross-sectional thickness, but its cross section width dimension increases at the top side of the arc-shaped piece 5 and next to its bottom. One of the sides of the arc-shaped piece 5 has a concave notch 9 that defines a coated portion 10 comprising a foamed material 8. The arc-shaped piece is constructed as a unitary part with the disc-shapes body and has an exterior and an interior surface. The dumbbell unit formed by the disc-shaped body and the hand retainer means is fabricated from a polymeric material, like acrylonitrile butadiene styrene (ABS), and its interior surface is coated with a foam material, like a polyurethane web.

The disc-shaped body 4 includes a hand-adapting means 6 formed by a pad or pillow 6 having a semispherical shape and constructed from a semi-soft material.

The disc-shaped body 4 includes on the opposed first face a locking mechanism comprising a threaded stem 7 formed of a metal such as steel.

A weight plate used with the device of the invention is typically a traditional disc weight, including a disc with a circular shape having a circular perforation or aperture formed through the center.

A single attachment means 2 is configured to attach one or more weight plates to one of the dumbbell unit 1, whereas the double attachment mean 3 attaches two dumbbells 1 units together with the double attachment means between.

The single attachment mean 2 includes a solid disc piece 211 having two opposite faces and a contouring wall, constructed of a polymeric material, preferably ABS, which contouring wall presents a plurality of elliptical depressions 212, providing a non-skid or gripping surface for improving the user's gripping and twisting action of the solid disc piece 211.

One of the two opposite faces of the single attachment means 2 includes a smooth surface, whereas the opposite face presents a central annular projection 213 with a threaded interior surface to fit and thread with the threaded stem 7 of the disc body and retain the weight plates to said dumbbell.

The double attachment means 3 consists of a solid disc shape piece 311, formed by two opposing faces and a contouring wall, with a vertical contouring wall, constructed in a polymeric material, preferably ABS. The vertical contouring wall presents a plurality of elliptical depressions 312, which act like a nonskid surface improving the user's gripping and twisting action of the piece 311.

Both opposing faces of said double attachment mean 3 include a central annular projection 313 having a threaded interior surface 314 to fit and thread with the threaded stem 7 of two disc-shaped body units and retain weight plates between them.

While the description and figures show and describe the preferred embodiment of the invention, it will be understood that the invention may be embodied otherwise than as herein specifically illustrated or described and that certain changes in form and arrangement of parts and the specific manner of practicing the invention may be made with the underlying idea or principles of the invention.

What is claim is:

1. A dumbbell system comprising:

two disc-shaped bodies with hand retainer means, each disc-shaped body comprises a first face and a second opposed face, a central projection protruding from the first face, and a hand adapting means including a pillow disposed in the opposite second face, wherein the hand retainer means including an arc-shaped piece disposed over the pillow;

at least a single weight plate attachment means, comprising a solid disc-shaped piece, having two opposite circular faces and a vertical contouring wall, wherein the contouring wall has a plurality of depressions, and further comprises a central annular projection having a threaded interior surface that projects from at least one of the circular faces; and a double weight plate attachment means, including a solid disc-shaped piece having two opposite circular faces and a vertical contouring wall, the contouring wall having a plurality of depressions, wherein a central annular projection having a threaded interior surface projects from both circular faces; wherein the dumbbell system allows a single arm working and alternatively a simultaneous and symmetrical working of both arms to fortify specific muscles, including biceps, triceps and back muscles; wherein each disc-shaped body may be attached to a single weight plate attachment means in order to be individually used; or both disc-shaped bodies may be attached to a double weight plate attachment means keeping said double weight plate attachment means between the disc-shaped bodies so this double attachment means allows fixing two dumbbell units by their body faces, so as to be used in a simultaneous and joint manner.

2. The dumbbell system according to claim 1 wherein the pillow has a semi spherical shape.

3. The dumbbell system according to claim 2 wherein the pillow is fabricated of polyurethane.

4. The dumbbell system according to claim 1 wherein the hand retainer means includes an arc-shaped piece having an interior surface and an exterior surface, and a constant cross sectional thickness, and wherein the width of the arc-shaped piece is increased at the top and at the bottom portions of the arc-shaped piece is attached to the second body face, thereby providing a concave notch proximate at least one of the bottom portions.

5. The dumbbell system according to claim 4 wherein the interior surface comprises a foam material and extends to cover the concave notch.

6. The dumbbell system according to claim 5 wherein the foam material is polyurethane.

7. The dumbbell system according to claim 1 wherein the disc-shaped body and the arc-shaped piece of each disc-shaped body with hand retainer means are constructed as a unitary polymeric part.

8. The dumbbell system according to claim 7 wherein the unitary polymeric part is ABS.

9. The dumbbell system according to claim 1 wherein the central projection disposed on the first face of the disc-shaped body comprises a threaded stem.

10. The dumbbell system according to claim 9 wherein said threaded stem is fabricated in steel.

11. The dumbbell system according to claim 1 wherein the depressions have an elliptical shape, and the disc-shaped piece is fabricated from acrylonitrile butadiene styrene (ABS) plastic.

12. The dumbbell system according to claim 1 wherein the annular projection is fabricated from steel.

13. The dumbbell system according to claim 1 wherein the annular projection having the threaded interior surface threads with the threaded stem of the dumbbell unit.

* * * * *